US010759552B2

(12) United States Patent
Murray

(10) Patent No.: US 10,759,552 B2
(45) **Date of Patent: *Sep. 1, 2020**

(54) MACHINE AND METHOD OF MANUFACTURING A TWO-COMPARTMENT POUCH

(71) Applicant: Pouch Pac Innovations, LLC, Sarasota, FL (US)

(72) Inventor: R. Charles Murray, Sarasota, FL (US)

(73) Assignee: Pouch Pac Innovations, LLC, Sarasota, FL (US)

( * ) Notice: Subject to any disclaimer, the term of this patent is extended or adjusted under 35 U.S.C. 154(b) by 298 days.

This patent is subject to a terminal disclaimer.

(21) Appl. No.: 15/961,391

(22) Filed: Apr. 24, 2018

(65) Prior Publication Data

US 2018/0237175 A1 Aug. 23, 2018

Related U.S. Application Data

(63) Continuation of application No. 14/862,785, filed on Sep. 23, 2015, now Pat. No. 9,981,761.

(60) Provisional application No. 62/053,976, filed on Sep. 23, 2014.

(51) Int. Cl.

| | |
|---|---|
| ***B65B 9/20*** | (2012.01) |
| ***B65D 81/32*** | (2006.01) |
| ***B65B 29/10*** | (2006.01) |

(52) U.S. Cl.

CPC ..... *B65B 9/2056* (2013.01); *B65B 9/2014* (2013.01); *B65B 29/10* (2013.01); *B65D 81/3266* (2013.01); *B65B 2220/22* (2013.01); *B65B 2230/02* (2013.01)

(58) Field of Classification Search

CPC ..... B65B 9/2014; B65B 9/2056; B65B 9/213; B65B 29/10; B65B 2220/22; B65B 2230/02; B65D 81/3266

USPC ..... 53/451, 551

See application file for complete search history.

(56) References Cited

U.S. PATENT DOCUMENTS

| | | | | |
|---|---|---|---|---|
| 2,732,989 | A | 1/1956 | Harker | |
| 3,262,244 | A | 7/1966 | Cutler et al. | |
| 3,410,051 | A | 11/1968 | Hayward | |
| 3,608,709 | A | 9/1971 | Pike | |
| 4,079,662 | A | 3/1978 | Puccetti et al. | |
| 4,552,613 | A | 11/1985 | Auer | |
| 4,604,854 | A | 8/1986 | Andreas | |
| 4,974,396 | A * | 12/1990 | Gaukler | B65B 9/213 493/197 |

(Continued)

FOREIGN PATENT DOCUMENTS

| | | | |
|---|---|---|---|
| DE | 2435017 | A1 | 2/1976 |
| DE | 19505880 | A1 | 8/1996 |

(Continued)

*Primary Examiner* — Stephen F. Gerrity

(74) *Attorney, Agent, or Firm* — Dinsmore & Shohl LLP

(57) ABSTRACT

A machine and a method for forming a two-compartment pouch having a lower compartment and an upper compartment The method includes the steps of drawing a film over a pair of fill tubes; sealing side edges of the film to form a sleeve; forming a bottom seal on the sleeve; pulling the sleeve downwardly; filling a bottom portion of the pouch using one of the fill tubes; forming a second seal over the filled bottom portion; filling an upper portion of the pouch using the other fill tube; and sealing the upper portion.

14 Claims, 4 Drawing Sheets

(56) References Cited

U.S. PATENT DOCUMENTS

| | | | |
|---|---|---|---|
| 5,067,310 | A | 11/1991 | Yamanaka |
| 9,981,761 | B2 * | 5/2018 | Murray ..... B65B 9/2056 |
| 2007/0240386 | A1 | 10/2007 | Zeedyk et al. |
| 2014/0361018 | A1 | 12/2014 | Edwards et al. |

FOREIGN PATENT DOCUMENTS

| | | | |
|---|---|---|---|
| DE | 10258634 | A1 | 6/2004 |
| EP | 0448440 | A1 | 9/1991 |
| WO | 2007106916 | A1 | 9/2007 |

* cited by examiner

MACHINE AND METHOD OF MANUFACTURING A TWO-COMPARTMENT POUCH

CROSS-REFERENCE TO RELATED APPLICATIONS

This application is a continuation application of U.S. patent application Ser. No. 14/862,785 filed on Sep. 23, 2015 which claims priority of U.S. Provisional Patent Application Ser. No. 62/053,976 filed on Sep. 23, 2014, both of which are incorporated herein in entirety by reference.

FIELD OF THE INVENTION

The present invention relates to a machine and a method of manufacturing a pouch, and in particular to a machine and a method of manufacturing a two-compartment pouch.

BACKGROUND OF THE INVENTION

Flexible pouches known as "stick packs" are elongated, rectangular pouches having a single side seal, bottom seal, and a top seal. Stick packs are formed on a vertical forming machine where the laminate material is pulled from a roll around a fill tube. Side edges of the laminate are then overlapped and sealed with a seal bar to form a tubular sleeve. Spaced a distance beneath the fill tube is a puller having a seal bar and die cut device. The seal bar forms a horizontal bottom seal across the sleeve. The puller then pulls the sleeve downwardly while the fill tube deposits material from a reservoir into the sleeve. When the puller has traveled the length of the stick pack, it stops and is moved upwardly to the start position where the seal bar places another horizontal seal in the sleeve to seal the contents in the sleeve. The die cutter then cuts through the seal so that a stick pack is formed and separated from the sleeve. The puller then repeats the process when the puller returns to the bottom.

SUMMARY OF THE INVENTION

A machine and a method for forming a two-compartment pouch having a lower compartment and an upper compartment are provided. The machine has a lower compartment fill tube and an upper compartment fill tube. The lower compartment fill tube is operable to fill a lower compartment and the upper compartment fill tube is operable to fill an upper compartment of the two-compartment pouch. The machine also includes a thin film drawer that is operable to pull or draw a thin film sheet. The thin film drawer draws the thin film over the lower compartment fill tube and the upper compartment fill tube such that side edges of the thin film sheet are aligned parallel and adjacent to each other.

A side seal bar is included and is operable to seal the pair of side edges to each other and thereby form a sleeve that extends around and downwardly from the lower compartment fill tube and the upper compartment fill tube.

A puller assembly can be included and has a lower seal bar with a die cutter and an upper seal bar that is spaced apart from the lower seal bar. The puller assembly is operable to move upwardly and downwardly in a vertical direction and thereby pull a sleeve of the thin film, and compartments formed from the sleeve, in a downward direction. The puller assembly can produce a bottom seal on the sleeve using the lower seal bar and in so doing initiates formation of a lower compartment for a two compartment pouch. The puller assembly then pulls the sleeve downwardly while the partially formed lower compartment is being filling by the lower compartment filler tube. Once a predetermined amount of product is filled into the lower compartment, the upper seal bar can produce an intermediate seal spaced apart from the bottom seal and thereby complete the lower compartment of the two-compartment pouch. In addition, the intermediate seal initiates formation of an upper compartment of the two-compartment pouch.

The puller assembly can move upwardly to a top position while the upper compartment fill tube is filling the partially formed upper compartment is being filled with the upper compartment filler tube. Once a predetermined amount of product is filled into the upper compartment, a top seal is produced on the sleeve using the lower seal bar and thereby complete the upper compartment of the two-compartment flexible pouch. At the same time, the lower seal bar also produces a bottom seal for the next two-compartment pouch to be manufactured. Finally, the die cutter makes a cut across or between the top seal and bottom seal and a completed two-compartment flexible pouch is separated from the sleeve while another two-compartment pouch is being manufactured in a similar manner.

The puller assembly can move upwardly and downwardly on a pair of vertical puller assembly support rods. In addition, the lower seal bar can be a pair of lower seal bars that move inwardly and outwardly with respect to each other and the sleeve. Likewise, the intermediate seal bar can be a pair of intermediate seal bars that move inwardly and outwardly with respect to each other and the sleeve. The pair of lower seal bars produce the top seal for a first two-compartment flexible pouch and the bottom seal for a second two-compartment flexible pouch and produces the top seal and the bottom seal at the same time. Stated differently, the top seal and the bottom seal can be a single seal that is between an upper compartment of the first two-compartment flexible pouch and a lower compartment of the second two-compartment flexible pouch. Furthermore, the die cutter can cut the single seal to remove the first two-compartment flexible pouch from the bottom seal of the sleeve which is in the process of being manufactured into the second two-compartment flexible pouch.

The process for manufacturing the two-compartment pouch includes providing the machine discussed above and providing a thin film sheet that has a pair of oppositely disposed side edges. The sheet is drawn over the lower compartment fill tube and the upper compartment fill tube using the thin film drawer and the pair of side edges are aligned parallel and adjacent to each other. The side seal bar seals the side edges together and thereby produces a sleeve of the thin film sheet. The sleeve of the thin film sheet extends in a downwardly direction and also surrounds at least a portion of the lower compartment fill tube and the upper compartment fill tube such that the tubes can provide products into the sleeve.

While the puller assembly is in a top position, a bottom seal is produced on the sleeve using the lower seal bar and the sleeve with the bottom seal is pulled downwardly with the puller assembly. In some instances, the lower compartment fill tube initiates filling of the bottom sealed sleeve with a first product while the puller assembly is pulling the sleeve with the bottom seal downwardly. After a desired amount of the first product is fed into the sleeve bounded by the bottom seal, an intermediate seal that is spaced apart from the bottom seal on the sleeve is produced using the upper seal bar. In this manner, the lower compartment of the two-compartment flexible pouch is formed between the bottom seal and the intermediate seal.

The puller assembly is then moved upwardly to a top position. In some instances, the upper compartment fill tube initiates filling of the sleeve above the intermediate seal with a second product while the puller assembly is moving upwardly to the top position. After a desired amount of the second product is filled into the sleeve above the intermediate seal, a top seal that is spaced apart from the intermediate seal on the sleeve is produced using the lower seal bar. In this manner, the upper compartment of the two-compartment flexible pouch is formed between the intermediate seal and the top seal. Finally, the two-compartment flexible pouch is cut or removed from the sleeve using the die cutter.

The intermediate seal can be a frangible seal so that when broken, the two products in the lower compartment and the upper compartment can be mixed together before opening the flexible pouch. In the alternative, the intermediate seal can be a permanent seal with perforations such that the two compartments can be detached and opened separately.

DETAILED DESCRIPTION OF THE INVENTION

Described is a method and machine for forming a novel two-compartment pouch. The method includes the steps of drawing a film over a pair of fill tubes; sealing side edges of the film to form a sleeve; forming a bottom seal on the sleeve; pulling the sleeve downwardly; filling a bottom portion of the pouch using one of the fill tubes; forming a second seal over the filled bottom portion; filling an upper portion of the pouch using the other fill tube; and sealing the upper portion.

The machine is a flexible pouch manufacturing apparatus that has a pair of fill tubes. For example, the pair of fill tubes can include a lower compartment fill tube and an upper compartment fill tube. The machine also includes a film drawer that is operable to draw a thin film that has a pair of oppositely disposed side edges over the pair of fill tubes. The film drawer is also operable to align the pair of side edges of the thin film such that they are parallel and adjacent to each other.

A side seal bar is included and is operable to seal the pair of side edges of the thin film to each other and thereby form a sleeve that extends around and downwardly from the pair of fill tubes. In this manner, thin film material or thin film sheet is taken from a roll of the material, unrolled, and formed into a sleeve that is then formed into a plurality of two-compartment pouches.

A puller assembly that has a lower seal bar with a die cutter and an upper seal bar spaced apart from the lower seal bar is also part of the machine. The puller assembly moves upwardly and downwardly in a vertical direction relative to the machine and the sleeve of the thin film. The puller assembly produces a bottom seal on the sleeve using the lower seal bar and then pulls the bottom sealed sleeve downwardly, e.g. while the lower compartment fill tube is filling the bottom sealed sleeve with a first product. The upper seal bar is then used to produce an intermediate seal that is spaced apart from the bottom seal and thereby produces a lower compartment of the two-compartment flexible pouch. The puller assembly then moves in an upwardly direction to a top position, e.g. while the upper compartment fill tube is filling the sleeve above the intermediate seal, i.e. the upper compartment. Once the upper compartment is filled to a desired level with the second product, a top seal is produced using the lower seal bar and thereby produces the upper compartment of the two-pouch flexible pouch. After the two compartments have been manufactured, the two-compartment flexible pouch is completed by cutting the top seal the sleeve above using the die cutter. The manufactured two-compartment flexible pouch can then be dropped or placed onto a conveyor belt for further processing such as printing thereon, weighing, indexing, packaging, and the like.

Figure 1:
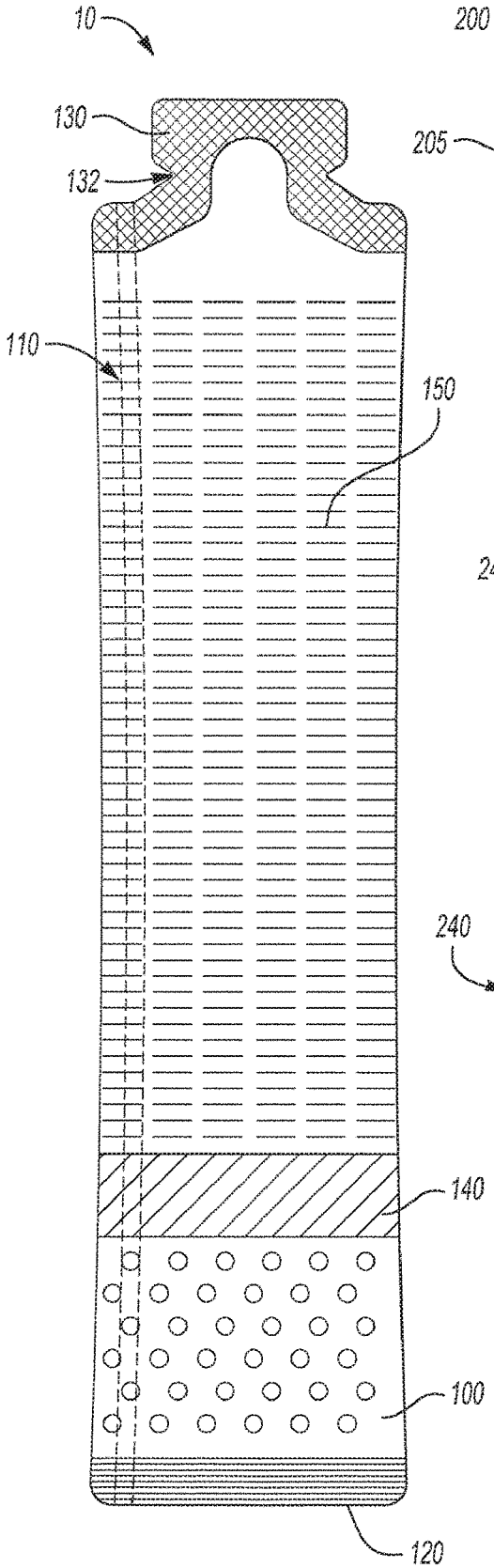
FIG. 1 is a schematic illustration of a two-compartment flexible pouch according to an aspect disclosed herein.

Turning now to FIG. 1, an inventive two-compartment pouch having a single side seal 110, a bottom seal 120, and a top seal 130 is shown generally at reference numeral 10. The two-compartment flexible pouch 10 has a lower compartment 100 and an upper compartment 150. The lower compartment 100 is formed by the bottom seal 120, an intermediate seal 140, and the side seal 110. The upper compartment 150 is formed by the intermediate seal 140, the side seal 110, and the top seal 130. The intermediate seal 140 can be a frangible seal so that when the seal is broken the products in the lower compartment 100 and the upper compartment 150 can be mixed together before opening the flexible pouch 10 via the top seal 130, e.g. using a tear notch 132. In the alternative, the intermediate seal 140 can be a permanent seal with perforations that afford for the lower compartment 100 to be detached and opened separately from the upper compartment 150.

Figure 2:
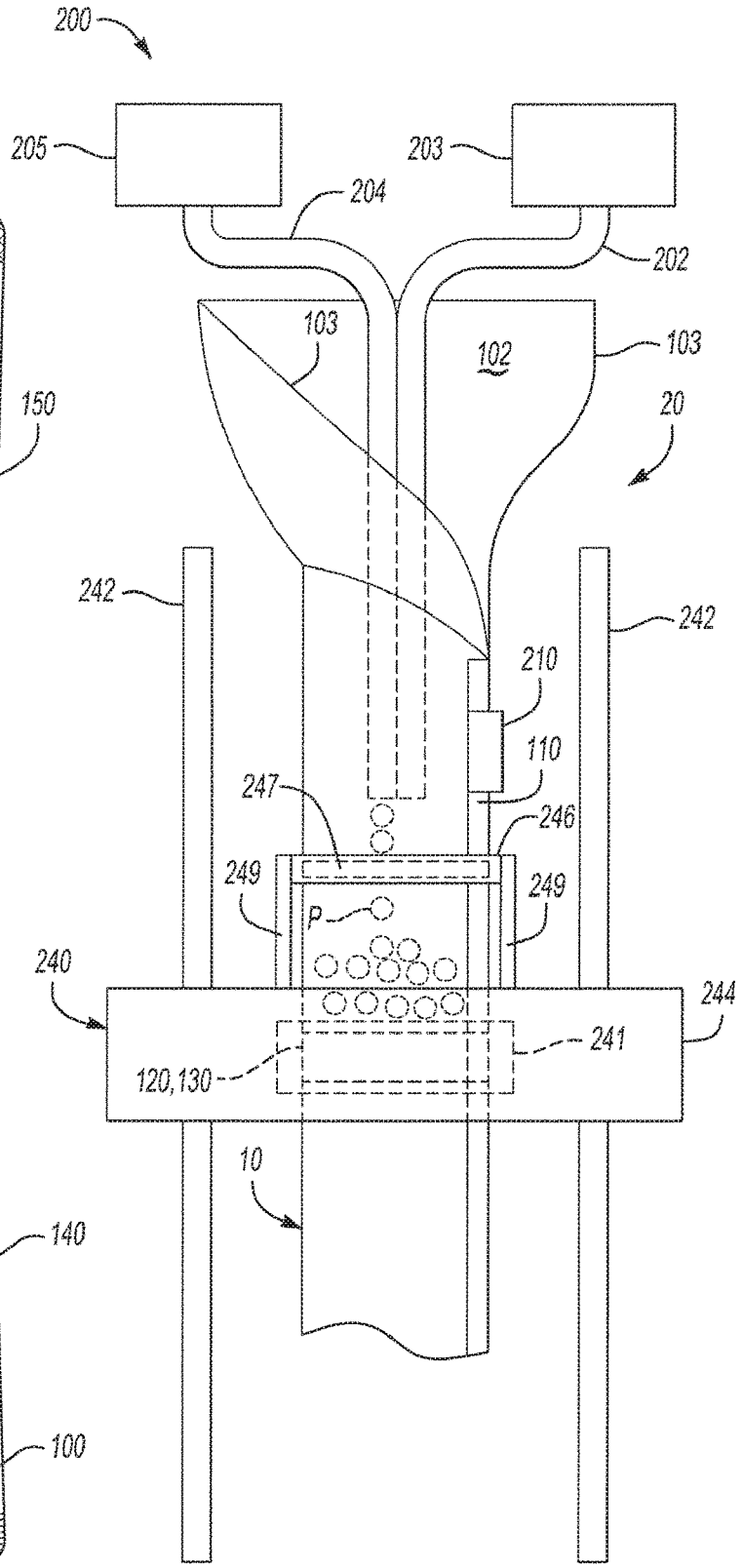
FIG. 2 is a schematic illustration of a machine for manufacturing a two-compartment flexible pouch according to an aspect disclosed herein.

Turning now to FIG. 2, a machine for manufacturing the two-compartment flexible pouch 10 shown in FIG. 1 is illustrated at reference numeral 20. The machine 20 includes a pouch filling system 200 that has a first filling tube 202, e.g. an upper compartment filling tube, and a second filling tube 204, e.g. a lower compartment filling tube. The first filling tube 202 is in fluid communication with a first reservoir 203 and the second filling tube 204 is in fluid communication with a second reservoir 205. The material in the reservoir 203 and/or 205 can be liquid, particulate, or solid. The reservoirs 203, 205 are located above the fill tubes 202, 204 and thus the contents of the reservoirs can be gravity fed. However, it is appreciated that this is not required and that filling materials can be provided to the filling tubes 202, 204 utilizing a pump, vacuum, etc.

As shown in FIG. 2, the filling tubes 202, 204 are positioned side by side, which in turn allows a sheet of flexible film 102 to be fed from behind and pulled around the filling tubes 202, 204 so that opposing side edges 103 of the flexible film 102 can overlap and be aligned vertically and parallel to each other. The machine 20 includes a side seal bar 210 which seals the edges 103 to each other and forms a continuous sleeve as in a conventional stick pack type machine. As such, the sleeve produced by the machine 20 has a single side seal 110.

The flexible sleeve formed by sealing the edges 103 to each other using the side seal bar is fed to a puller assembly 240 which can be mounted on a pair of support and/or guide rods 242. It is appreciated that the puller assembly 240 can move reciprocally upwardly and downwardly, e.g. using a pneumatic cylinder, a hydraulic cylinder, a mechanical drive system, and the like.

Figure 5:
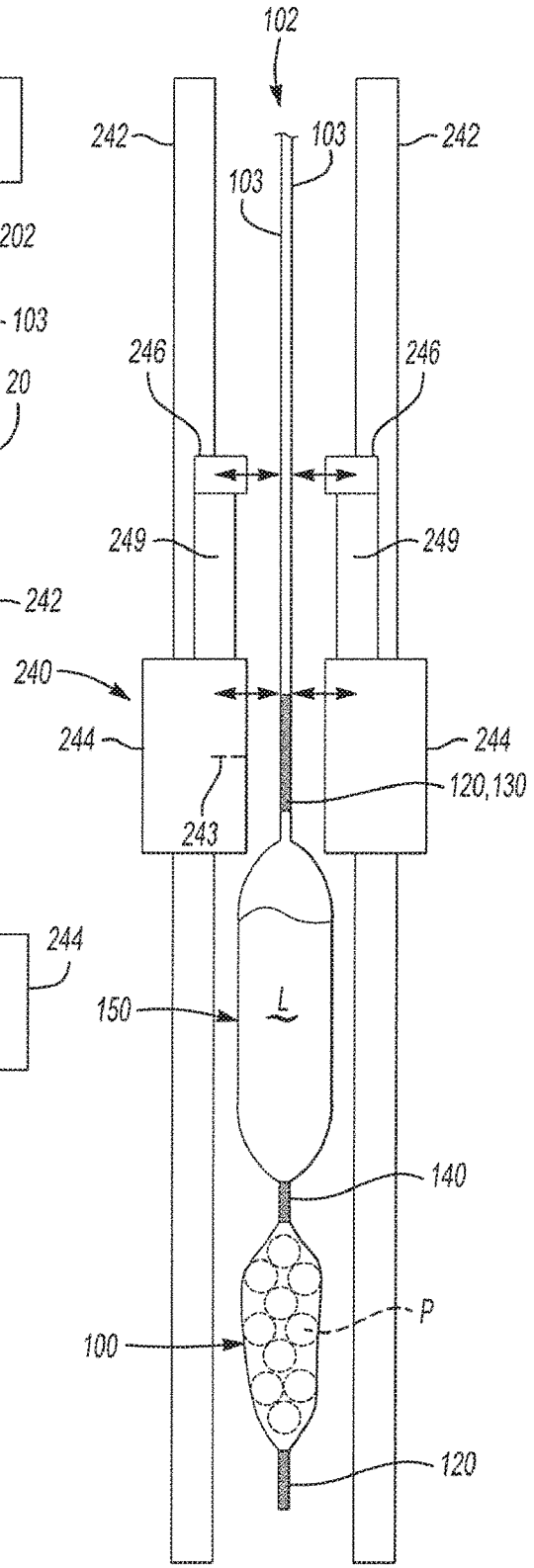
FIG. 5 is a side cross-sectional view of the machine shown in FIG. 4.

The puller assembly 240 has a lower seal bar 244 which can be a pair of lower seal bars 244 (e.g. see FIG. 5). The lower seal bar 244 has a sealing portion 241 which can seal opposing sides of the sleeve using heat, pressure, ultrasound, and the like. As such, the seal bar 244 can produce a seal across the sleeve which affords for separate compartments to be present below the seal and above the seal. In particular, FIG. 2 illustrates the lower seal bar 244 providing a bottom seal 120 for a flexible pouch that is just starting to be manufactured and a top seal 130 for a flexible pouch that is being completed. A product P can be supplied within the sleeve above the bottom seal 120 using the filling tube 204.

Figure 3:
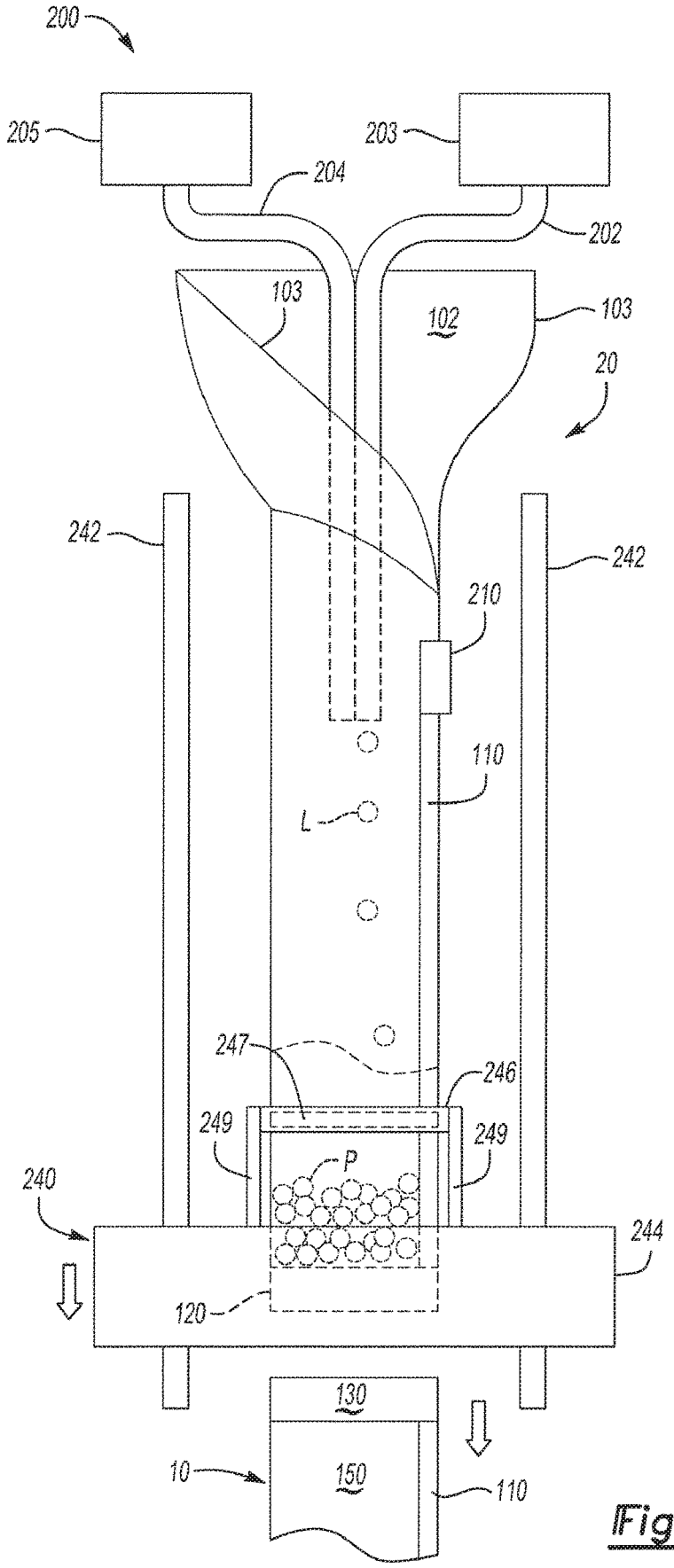
FIG. 3 is a schematic illustration of the machine shown in FIG. 2 with a puller assembly at a different position.

Before, during, and/or after filling of the sleeve above the bottom seal 120 with the product P, the puller assembly 240 pulls the sleeve in a downward direction to a bottom position as illustrated in FIG. 3. In addition, FIG. 3 illustrates that a lower compartment of the sleeve has been filled and an upper seal bar 246 with a sealing portion 247 has produced an intermediate seal 140. Furthermore, after the intermediate seal 140 has been produced, a second product L is dispersed into the sleeve above the intermediate seal 140 using the fill tube 202. In this manner, the lower compartment 100 of a two-compartment flexible pouch has been manufactured and the upper compartment 150 is being filled with a desired product L.

Also shown in FIG. 3, the lower seal bar 244 with a die cutter 243 affords for cutting of the seal 120, 130 such that a two-compartment flexible pouch 10 with the top seal 130 is removed from the bottom seal 120 of the next flexible pouch to be manufactured.

Figure 4:
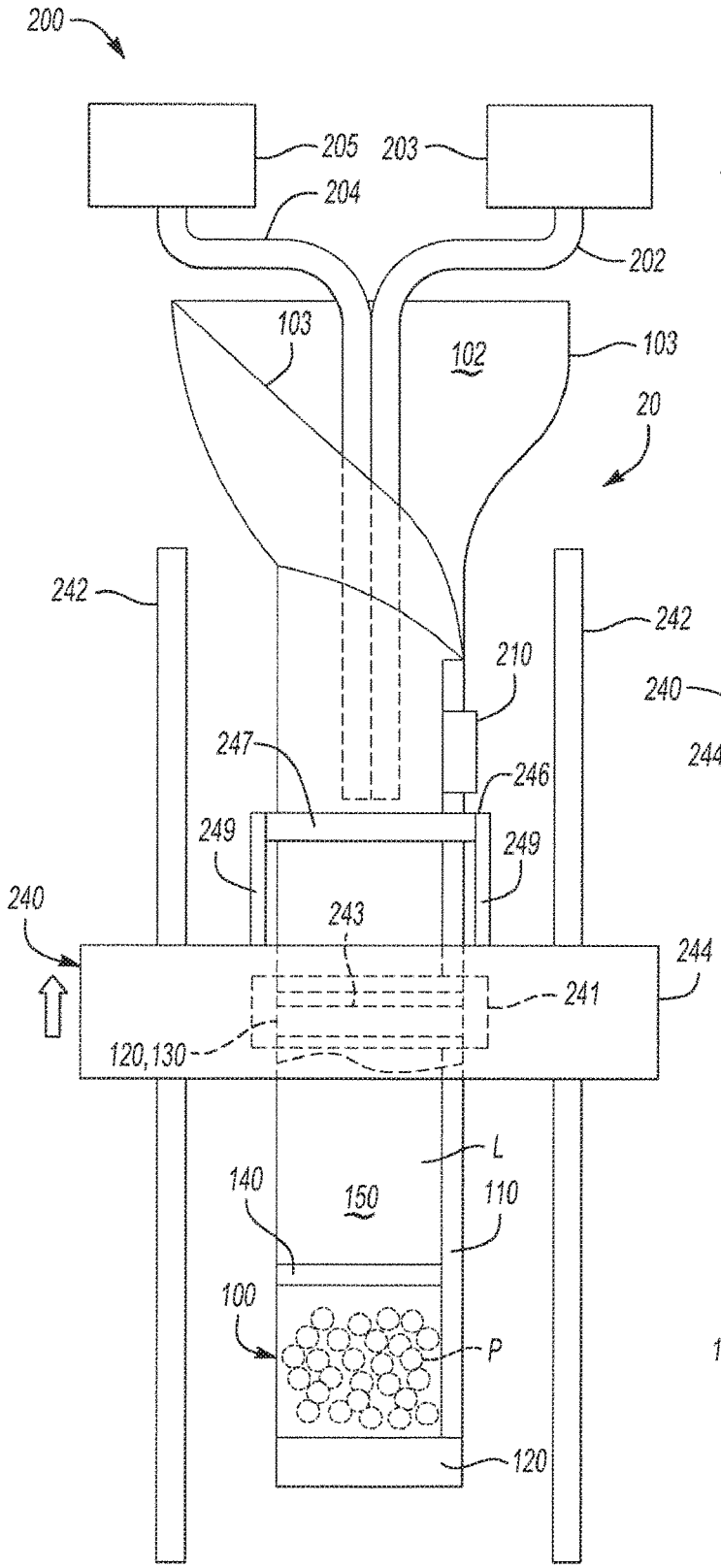
FIG. 4 is a schematic illustration of the machine shown in FIG. 3 with a puller assembly in a different position.

After the intermediate seal 140 has been completed or manufactured, the puller assembly 240 can move in an upwardly direction to a top position as illustrated in FIG. 4. In addition, and upon completion of filling the sleeve above the intermediate seal 140 with the product L to a desired level, the lower seal bar 244 affords for the top seal 130 to be produced. It is appreciated that during the production of the top seal 130, the bottom seal 120 for the next two-compartment flexible pouch to be manufactured is also produced. After the top seal 130 is produced on the sleeve, the machine and process repeats the cycle with the filler tube 204 providing product P within the sleeve and above the bottom seal 120.

Turning now to FIG. 5, a side cross-sectional view of the machine and flexible pouch being manufactured in FIG. 4 is shown. As shown in the figure, the puller assembly can have a pair of oppositely disposed lower seal bars 244 and a pair of oppositely disposed upper seal bars 246. It is appreciated that the upper seal bars 246 are spaced apart from the pair of lower seal bars 244, e.g. using one or more support bars or beams 249. In addition, the upper seal bars 246 can be spaced apart from the lower seal bars 244 a distance that is equal to the length of the lower compartment 100. Stated differently, the puller assembly 240 can produce the bottom seal 120 and the intermediate seal 140 on the sleeve without movement of the sleeve relative to the puller assembly 240.

Figure 6:
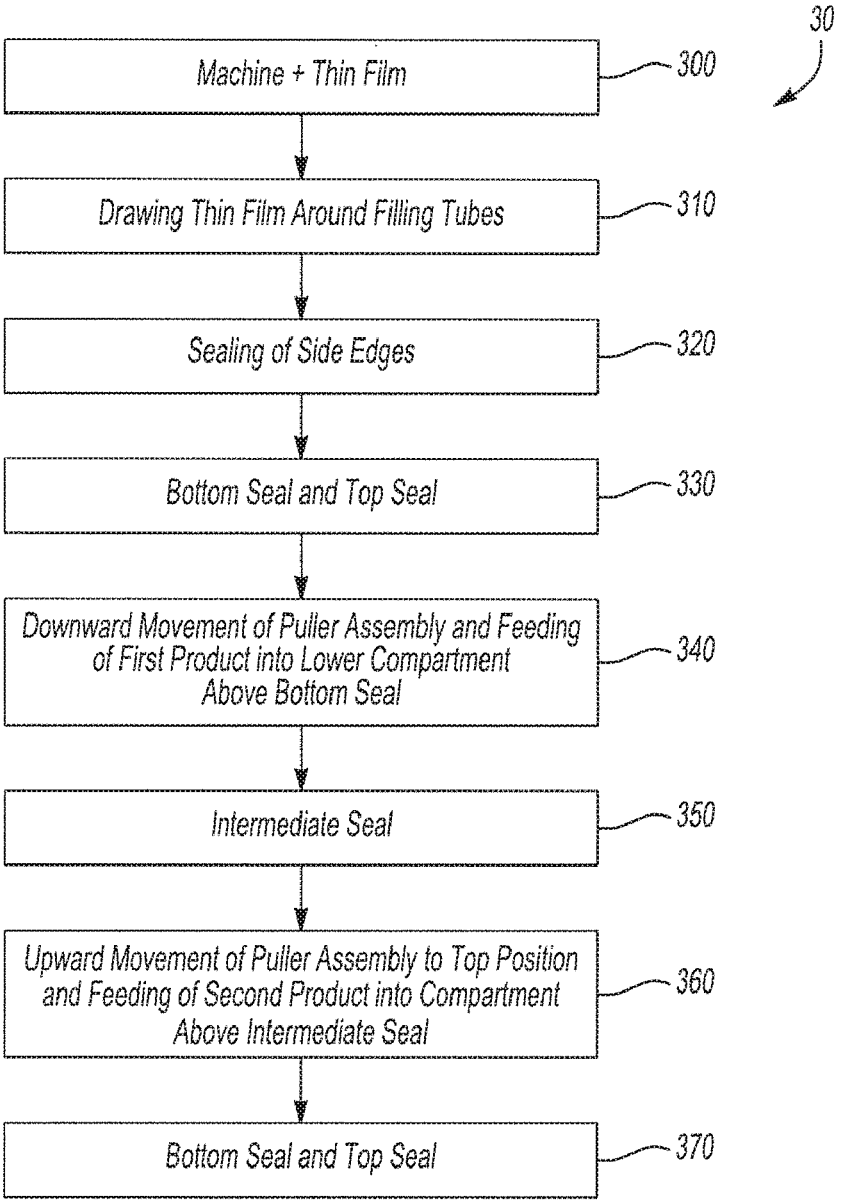
FIG. 6 is a schematic illustration of a process for manufacturing a two-compartment flexible pouch according to an aspect disclosed herein.

Referring now to FIG. 6, a schematic flowchart of a process for making a two-compartment flexible pouch using the machine 20 is provided and shown generally at reference numeral 30. The process 30 includes providing the machine 20 and a thin film sheet at step 300, followed by drawing the thin film sheet around the pair of fill tubes at step 310. The side edges of the thin film sheet that has been drawn around the fill tubes are sealed at step 320. A top seal for a first two-compartment pouch that is nearing manufacture completion and a bottom seal for a second two-compartment pouch that is just beginning to be manufactured is produced across the sleeve at step 330.

Once the bottom seal is produced, the puller assembly pulls the sleeve material with the bottom seal in a downward direction and a filler tube fills the sleeve above the bottom seal, i.e. the lower compartment, with a first product at step 340. Upon completion of filling the lower compartment, an intermediate seal is produced at step 350. In addition, a die cutter that is part of the puller assembly can cut between the tops seal of the first two-compartment pouch and the bottom seal of the second two-compartment pouch either before, during or after the intermediate seal is produced.

After the intermediate seal is produced, the puller assembly moves in an upwardly direction to a top position at step 360. Upon completion of filling the upper compartment above the intermediate seal with a second product, the lower seal bar produces a top seal for the second two-compartment flexible pouch and a bottom seal for another two-compartment pouch to be manufactured at step 370. Thereafter, the cycle repeats and the filling tube 204 begins to provide the first product into a lower portion of the next two-compartment flexible pouch that is being manufactured.

The above examples, aspects, and embodiments described above are for illustrative purposes only and are not meant to and do not limit the scope of the instant disclosure. Changes, modifications, and the like will be apparent to those skilled in the art and yet fall within the scope of the instant disclosure. As such, it is the claims, and all equivalents thereof, which define the scope of the invention.

I claim:

1. A machine for forming a two-compartment flexible pouch having a lower compartment and an upper compartment, said machine comprising:

a lower compartment fill tube and an upper compartment fill tube, said lower compartment fill tube operable to fill the lower compartment of the two-compartment flexible pouch and said upper compartment fill tube operable to fill the upper compartment of the two-compartment flexible pouch;

a film drawer operable to draw a film comprising a pair of oppositely disposed side edges around said lower compartment fill tube and said upper compartment fill tube, said film drawer also operable to align said pair of side edges parallel and adjacent to each other;

a side seal bar operable to seal said pair of side edges to each other and form a sleeve extending around and downwardly from said lower compartment fill tube and said upper compartment fill tube; and a puller assembly comprising a lower seal bar with a die cutter and an upper seal bar spaced apart from said lower seal bar, wherein:

the lower seal bar is operable to produce a single seal comprising a top seal for a first two-compartment pouch and a bottom seal for a second two-compartment pouch; and the die cutter is operable to cut said single seal between said top seal and said bottom seal.

2. The machine of claim 1, wherein said puller assembly moves upwardly and downwardly on a pair of vertical puller assembly support rods.

3. The machine of claim 1, wherein said lower seal bar is a pair of lower seal bars that move inwardly and outwardly with respect to each other and said sleeve.

4. The machine of claim 1, wherein said upper seal bar is a pair of upper seal bars that move inwardly and outwardly with respect to each other and said sleeve.

5. The machine of claim 1, wherein said single seal is between an upper compartment of the first two-compartment flexible pouch and a lower compartment of the second two-compartment flexible pouch.

6. The machine of claim 5, wherein said die cutter cuts said single seal to remove said first two-compartment flexible pouch from said second two-compartment flexible pouch.

7. A process for manufacturing two-compartment flexible pouches pouch comprising:

drawing a film sheet comprising a pair of oppositely disposed side edges around a lower compartment fill tube and an upper compartment fill tube of a two-compartment pouch manufacturing machine, the two-compartment pouch manufacturing machine comprising:

a side seal bar; and a puller assembly comprising a lower seal bar with a die cutter and an upper seal bar spaced apart from said lower seal bar;

aligning the pair of oppositely disposed side edges of the film sheet parallel and adjacent to each other;

sealing the side edges together using the side seal bar and forming a sleeve of the film sheet;

forming a bottom seal on the sleeve for a first two-compartment flexible pouch using the lower seal bar;

pulling the bottom sealed sleeve downwardly using the puller assembly while the lower compartment fill tube fills the bottom sealed sleeve with a first product;

forming an intermediate seal spaced apart from the bottom seal on the sleeve using the upper seal bar, wherein a lower compartment for the first two-compartment flexible pouch is formed between the bottom seal and the intermediate seal;

forming a single seal using the lower seal bar, the single seal comprising a top seal for the first two-compartment flexible pouch and another bottom seal for a second two-compartment flexible pouch, wherein the top seal is spaced apart from the intermediate seal on the sleeve and an upper compartment of the first two-compartment flexible pouch is formed between the intermediate seal and the top seal; and cutting the single seal and separating the top seal of the first two-compartment flexible pouch from the bottom seal of the second two-compartment flexible pouch.

8. The process of claim 7, wherein the lower seal bar produces the top seal for the first two-compartment flexible pouch and the bottom seal for the second two-compartment flexible pouch at the same time.

9. The process of claim 7, wherein the single seal is between the upper compartment of the first two-compartment flexible pouch and a lower compartment of the second two-compartment flexible pouch.

10. The process of claim 7, wherein the die cutter cuts the single seal to remove the first two-compartment flexible pouch from the second two-compartment flexible pouch.

11. The process of claim 7, wherein the lower seal bar is a pair of lower seal bars moving inwardly and outwardly with respect to each other to form the single seal comprising the top seal for the first two-compartment flexible pouch and the bottom seal for the second two-compartment flexible pouch.

12. The process of claim 7, wherein the upper seal bar is a pair of upper seal bars moving inwardly and outwardly with respect to each to form the intermediate seal.

13. The process of claim 7, wherein the puller assembly moves upwardly and downwardly on a pair of vertical puller assembly support rods.

14. The process of claim 7, wherein the upper compartment fill tube fills the upper compartment of the first two-compartment flexible pouch with a second product before the top seal of the first two-compartment flexible pouch is formed using the lower seal bar.

* * * * *